US008231197B2

(12) United States Patent
Hashimoto

(10) Patent No.: US 8,231,197 B2
(45) Date of Patent: Jul. 31, 2012

(54) SEMICONDUCTOR DEVICE, INK CARTRIDGE, AND ELECTRONIC DEVICE

(75) Inventor: Nobuaki Hashimoto, Suwa (JP)

(73) Assignee: Seiko Epson Corporation (JP)

( * ) Notice: Subject to any disclaimer, the term of this patent is extended or adjusted under 35 U.S.C. 154(b) by 115 days.

(21) Appl. No.: 12/824,486

(22) Filed: Jun. 28, 2010

(65) Prior Publication Data

US 2010/0258901 A1 Oct. 14, 2010

Related U.S. Application Data

(62) Division of application No. 11/712,364, filed on Feb. 28, 2007, now Pat. No. 7,780,281.

(30) Foreign Application Priority Data

Mar. 10, 2006 (JP) ..... 2006-065637

(51) Int. Cl.
*B41J 29/393* (2006.01)

(52) U.S. Cl. ..... 347/19; 347/86

(58) Field of Classification Search ..... None
See application file for complete search history.

(56) References Cited

U.S. PATENT DOCUMENTS

| | | | |
|---|---|---|---|
| 5,162,817 | A | 11/1992 | Tajika et al. |
| 5,289,211 | A | 2/1994 | Morandotti et al. |
| 5,988,783 | A | 11/1999 | Tajika et al. |
| 6,984,012 | B2 | 1/2006 | Asauchi |
| 6,994,415 | B2 | 2/2006 | Asauchi et al. |
| 7,059,696 | B2 | 6/2006 | Eguchi et al. |
| 7,192,107 | B2 | 3/2007 | Fukano et al. |
| 7,267,421 | B2 | 9/2007 | Asauchi et al. |
| 7,446,336 | B2 | 11/2008 | Yamazaki et al. |
| 7,556,363 | B2 | 7/2009 | Yamamoto |
| 7,561,052 | B2 | 7/2009 | Arai et al. |
| 2002/0089555 | A1 | 7/2002 | Kobayashi et al. |
| 2003/0128245 | A1 | 7/2003 | Walker |
| 2004/0164302 | A1 | 8/2004 | Arai et al. |
| 2005/0012766 | A1 | 1/2005 | Fukano et al. |
| 2005/0231547 | A1 | 10/2005 | Hatasa et al. |
| 2005/0270315 | A1* | 12/2005 | Yamamoto ..... 347/7 |
| 2006/0203017 | A1 | 9/2006 | Eguchi et al. |
| 2007/0211087 | A1 | 9/2007 | Hashimoto |
| 2008/0024402 | A1* | 1/2008 | Nishikawa et al. ..... 345/82 |
| 2008/0271316 | A1 | 11/2008 | Yamamoto |
| 2008/0291227 | A1 | 11/2008 | Yamamoto |
| 2009/0128338 | A1 | 5/2009 | Arai et al. |

FOREIGN PATENT DOCUMENTS

| | | | |
|---|---|---|---|
| EP | 1 088 668 | A1 | 4/2001 |
| EP | 1 382 449 | A1 | 1/2004 |
| EP | 1 602 490 | A2 | 12/2005 |
| JP | 02-198867 | | 8/1990 |
| JP | 07-047686 | | 2/1995 |
| JP | 2000-171285 | | 6/2000 |

(Continued)

*Primary Examiner* — Matthew Luu
*Assistant Examiner* — Justin Seo
(74) *Attorney, Agent, or Firm* — Harness, Dickey & Pierce, PLC

(57) ABSTRACT

A semiconductor device includes: a semiconductor substrate including an active element formation face on which an active element is formed; detection electrodes detecting a remaining amount of ink by being wet in the ink; an antenna transmitting and receiving information; a storage circuit storing information relating to the ink; and a control circuit controlling the detection electrodes, the antenna, and the storage circuit.

6 Claims, 9 Drawing Sheets

FOREIGN PATENT DOCUMENTS

| | | |
|---|---|---|
| JP | 2002-257616 | 9/2002 |
| JP | 2002-283586 | 10/2002 |
| JP | 2003-291367 | 10/2003 |
| JP | 2004-050542 | 2/2004 |
| JP | 2004-106382 | 4/2004 |
| JP | 2004-338394 | 12/2004 |
| JP | 2005-251176 | 9/2005 |
| JP | 2005-343037 | 12/2005 |
| JP | 2006-024817 | 1/2006 |
| KR | 2004-0076223 | 8/2004 |

* cited by examiner

SEMICONDUCTOR DEVICE, INK CARTRIDGE, AND ELECTRONIC DEVICE

CROSS-REFERENCE TO RELATED APPLICATION

This is a divisional application of U.S. Ser. No. 11/712,364 filed Feb. 28, 2007 which claims priority to Japanese Patent Application No. 2006-065637, filed Mar. 10, 2006, the contents of which are incorporated herein by reference.

BACKGROUND

1. Technical Field

The present invention relates to a semiconductor device, an ink cartridge, and an electronic device.

2. Related Art

There are conventional methods of managing ink consumption of ink cartridges in printers or the like that use ink for recording.

An example of such management methods is one which calculates ink consumption by using software to integrate the number of ink droplets ejected at the recording head and the amount of ink absorbed by maintenance.

However, this management method of using software to calculate ink consumption has problems such as the following.

There is weight variation in the ink droplets ejected in the head.

Although this weight variation of the ink droplets does not affect the image quality, it causes ink consumption amount errors which accumulate in the ink cartridge.

Consequently, the remaining amount of ink obtained by calculation and the actual remaining amount of ink differ, so that ink remains in the ink cartridge even though the remaining amount of ink is displayed as zero.

Users have noticed that exchanging a used ink cartridge with a new one even when ink remains results in a waste of the remaining ink.

In order to solve this problem, Japanese Unexamined Patent Application, First Publication No. 2002-283586 discloses a technique that uses a piezoelectric device to monitor the remaining amount of ink in an ink cartridge.

According to this method, the remaining amount of ink in the ink cartridge can be monitored using changes in the resonance frequency of a residual vibration signal generated by residual vibration of a vibration unit of the piezoelectric device.

However, in Japanese Unexamined Patent Application, First Publication No. 2002-283586, the sensor structure is complex and the accompanying system also becomes complex, increasing manufacturing costs.

Furthermore, when the ink cartridge is set inside a holder, an electrode terminal connected to the piezoelectric device contacts a contact terminal and becomes electrically connected to it.

Consequently, there is concern over the reliability of the electrical contact point between the ink cartridge and the main frame, and users notice that ink is wasted.

In the related art, systems wherein a detector for detecting ink information is independent from a storage unit for storing the ink information often store ink information detected via the main frame in the storage unit.

Consequently it is difficult to synthesize both types of information, and to perform simple and detailed information management such as ensuring that the ink cartridge cannot function unless it is set in the main device.

SUMMARY

An advantage of some aspects of the invention is to provide a semiconductor device, an ink cartridge, and an electronic device, in which it is possible to detect and manage information relating to ink in an ink cartridge accurately and reliably with a simple configuration, while preventing wasteful use of ink and increasing the satisfaction of the user.

A first aspect of the invention provides a semiconductor device including: a semiconductor substrate including an active element formation face on which an active element is formed; detection electrodes detecting a remaining amount of ink by being wet in the ink; an antenna transmitting and receiving information; a storage circuit storing information relating to the ink; and a control circuit controlling the detection electrodes, the antenna, and the storage circuit.

According to this configuration, the detection electrodes, the antenna, the control circuit, and the storage circuit can be provided collectively in an all-in-one semiconductor device.

This simplifies manufacture and reduces cost, without generating troublesome operation when incorporating the ink cartridge.

By measuring the resistance/current between the detection electrodes, it is possible to detect the remaining amount (actual amount) of ink in the container, etc.

By this means, it possible to reliably ascertain whether ink is present in the ink cartridge.

Therefore, the ink cartridge can be replaced after using all of the ink, without leaving any in the container.

Therefore, the cost of the ink for the user can be reduced, increasing his satisfaction.

This important feature is common to all the effects described below.

Furthermore, since ink information from the electronic device unit (color, count number of ejected droplets, etc.) and ink information from the detection electrodes on the ink cartridge (remaining amount, actual amount, etc.) can be stored collectively in the storage circuit, information relating to the ink can be managed over a broad range.

By using the antenna, it possible to perform wireless transmissions between the electronic device unit and the ink cartridge, and to refer to content information stored in the storage circuit, write to the storage circuit, and so on, even if the ink cartridge is not attached to the electronic device unit.

Since this removes concern over electrical contact between the electronic device unit and the ink cartridge as in the related art, reliability is increased.

By transmitting and receiving the information by this non-contact method, the cost of information management can be reduced.

It is preferable that, in the semiconductor device of the first aspect of the invention, the antenna and the detection electrodes be included in a layer and disposed on or above the active element formation face.

According to this configuration, since the antenna and the detection electrodes can be formed by the same layer on the same face, they can be formed simultaneously.

This reduces the number of manufacturing steps and the manufacturing cost.

It is preferable that the semiconductor device of the first aspect of the invention further include: a passivation film interposed between the active element formation face and the layer including the detection electrodes and the antenna, the layer being a conductive layer.

According to this configuration, since the detection electrodes and the antenna are formed by the conductive layer, the active element formation face can be used effectively, increasing the packaging efficiency.

Also, since the passivation film can protect the active elements and make the active element formation face smooth, the conductive layer is easier to form.

It is preferable that the semiconductor device of the first aspect of the invention further include: a protective film formed so as to cover the conductive layer; and an opening formed in the protective film, exposing at least a part of the conductive layer. In this structure, the detection electrodes are constituted by the part of the conductive layer exposed through the opening.

According to this configuration, since part of the conductive layer exposed through the opening constitutes the detection electrodes, the detection electrodes can be arranged such that its position deviates from the physical positions of electrodes of an integrated circuit formed on the active element formation face, thereby preventing the integrated circuit from being affected by the ink.

Also, since the size of the area of the detection electrodes depends on the size of the opening, the detection electrodes can be formed in a desired size (range).

It is preferable that the semiconductor device of the first aspect of the invention further include: a protective film formed so as to cover the conductive layer; an opening formed in the protective film, exposing at least a part of the conductive layer; and a bump formed on the conductive layer exposed through the opening. In this structure, the detection electrodes are constituted by the bump.

According to this configuration, since the bump formed on the conductive layer constitutes the detection electrodes, the distance between the active element formation face and the detection electrodes can be increased. This can prevent the ink from affecting the active element formation face.

It is preferable that the semiconductor device of the first aspect of the invention further include: a plated layer formed on a surface of the detection electrodes.

In this configuration, the plated layer is formed by plating the detection electrodes contacting the ink with, for example, a metal having excellent chemical resistance.

Therefore, corrosion of the detection electrodes is prevented, and it is possible to prevent infiltration of ink to its internal part, thereby preventing the ink from affecting the active elements.

Since most inks are generally strongly alkaline, infiltration of ink can be reliably prevented by using a chemical resistant metal as the plating material.

It is preferable that the semiconductor device of the first aspect of the invention further include: a dielectric layer formed on or below a bottom layer of the detection electrodes and the antenna.

According to this configuration, the antenna characteristics can be enhanced by forming the dielectric layer on or below the bottom layer of the antenna.

Furthermore, since the distance from the active element formation face to the detection electrodes can be further increased by forming the dielectric layer on or below the bottom layer of the detection electrodes, chemical damage to the active elements caused by the ink can be prevented.

It is preferable that, in the semiconductor device of the first aspect of the invention, the antenna and the detection electrodes be formed directly on the active element formation face using the same conductive material as that constituting the active element formed on the semiconductor substrate.

According to this configuration, the integrated circuit including the active elements, the antenna, and the detection electrodes can be formed in one operation, making manufacture easy.

It is preferable that the semiconductor device of the first aspect of the invention further include: three or more detection electrodes.

According to this configuration, even if the detection precision of, say, two of the detection electrodes deteriorates due to the presence of an air bubble or dirt between them, it is possible to compensate by the detection precision between the other detection electrodes, and accurate ink information indicating whether ink is present can be obtained.

A second aspect of the invention provides an ink cartridge used for an electronic device unit including an antenna, the ink cartridge including: an ink cartridge casing including a container that accommodates ink; and a liquid sensor including a semiconductor device that detects and manages information relating to the ink accommodated in the container. In this structure, the semiconductor device includes: a semiconductor substrate; detection electrodes exposed in the container and embedded in the ink cartridge casing, and detecting the ink by being wet in the ink; an antenna transmitting and receiving information to or from the antenna of the electronic device unit; a storage circuit storing information relating to the ink; and a control circuit controlling the detection electrodes, the antenna, and the storage circuit.

According to this configuration, since the detection electrodes is exposed in the container, the amount (presence) of ink remaining in the container can be reliably detected by direct contact between the detection electrodes and the ink.

Furthermore, ink information such as whether the container has been filled with ink, the filling date, the ink depleted date, the number of fillings, and so on, can be stored beforehand in the storage circuit, and managed collectively in the storage circuit together with detailed information relating to the ink itself.

Thus, it is possible to replace the ink cartridge after all the ink is used, without leaving any ink in the container.

In this way, it is possible to construct a system that transmits precisely detailed information to the user who is managing the information in precise detail.

Even if the ink cartridge is not attached in the printer unit, it is possible to refer to the content information of the storage circuit, write to the storage circuit, and so on; in addition, ink information from the detection electrodes can be stored in the storage circuit without passing via the printer unit, thereby it possible to detect and manage the ink information in ink cartridge units, increasing the versatility of the ink cartridge.

Since it is possible to give management/detection functions to the ink cartridge side, the number of interconnections on the electronic device unit can be reduced and the structure can be simplified.

Therefore, the design layout of the electronic device unit can be made freer.

Furthermore, since parts of the semiconductor device other than the detection electrodes are embedded in the ink cartridge, the ink is prevented from infiltrating to the semiconductor substrate, and chemical damage to the active elements formed on these other parts caused by the ink can also be prevented.

Since the semiconductor device is embedded in the ink cartridge casing, unwanted leakage of ink solution can be prevented, increasing the satisfaction of the user.

It is preferable that, in the ink cartridge of the second aspect of the invention, a plurality of pairs of the detection electrodes of the semiconductor device be formed along the depth direction of the container, the detection electrodes being arranged along a bottom face of the container.

According to this configuration, as the amount of ink decreases, information (liquid level) indicating that there is no ink between the detection electrodes can be detected sequentially from between the detection electrodes thereabove.

Moreover, when information indicating that there is no ink is detected at the detection electrodes along the bottom face, information indicating that the ink has not completely emptied from the ink cartridge can be obtained.

Consequently, it is possible not only to obtain accurate information indicating whether ink is present, but also to obtain timely and precise information relating to the gradually decreasing amount of ink.

The user often becomes particularly concerned when the remaining amount of ink in the ink cartridge decreases.

With this type of configuration, when the remaining amount of ink in the ink cartridge decreases to a level that concerns the user, the user can obtain timely information relating to the remaining amount of ink. Thus, the user's satisfaction can be greatly increased.

It is preferable that, in the ink cartridge of the second aspect of the invention, a plurality of the semiconductor devices be formed along the depth direction of the container, the detection electrodes of at least one of the semiconductor devices being arranged along a bottom face of the container.

According to this configuration, by providing the plurality of semiconductor devices along the depth direction of the container, the liquid level of the ink can be detected and the remaining amount of ink can be accurately ascertained.

In addition, by arranging the detection electrodes of at least one of the semiconductor devices along the bottom face of the container, it is possible to accurately detect whether ink is present in the container, enabling the ink to be used without leaving any behind.

Similarly in this configuration, when the remaining amount of ink in the ink cartridge decreases to a level that concerns the user, he can obtain timely information relating to the remaining amount of ink, greatly increasing his satisfaction.

A third aspect of the invention provides an electronic device including the above described ink cartridge, and an electronic device unit including an antenna.

According to this configuration, since ink information such as that described above can be detected and managed reliably, for example, an appropriate replacement period for the ink cartridge can be determined.

Since it is possible to replace the ink cartridge without leaving any ink in the container, the replacement cycle of the ink cartridge can be extended and the ink-related cost can be reduced.

By managing detailed ink information in this way, the ink cartridge can be recycled efficiently and without waste.

Information such as the number of recycles of the ink cartridge can be determined from, for example, information relating to the number of ink fillings; this information is useful not only in achieving functions that are essential in servicing the user, but also from an environmental perspective as regards recycling.

Obviously, a highly reliably, high-quality product can thereby be provided.

DESCRIPTION OF EXEMPLARY EMBODIMENTS

Embodiments of a semiconductor device, an ink cartridge, and an electronic device according to the invention will be explained with reference to FIGS. 1 to 10.

Semiconductor devices 1 and 41 are contained in an ink cartridge 7 which is attached to a printer unit 23 (electronic device unit) including a first antenna 22 described later.

Semiconductor Device

Figure 1:
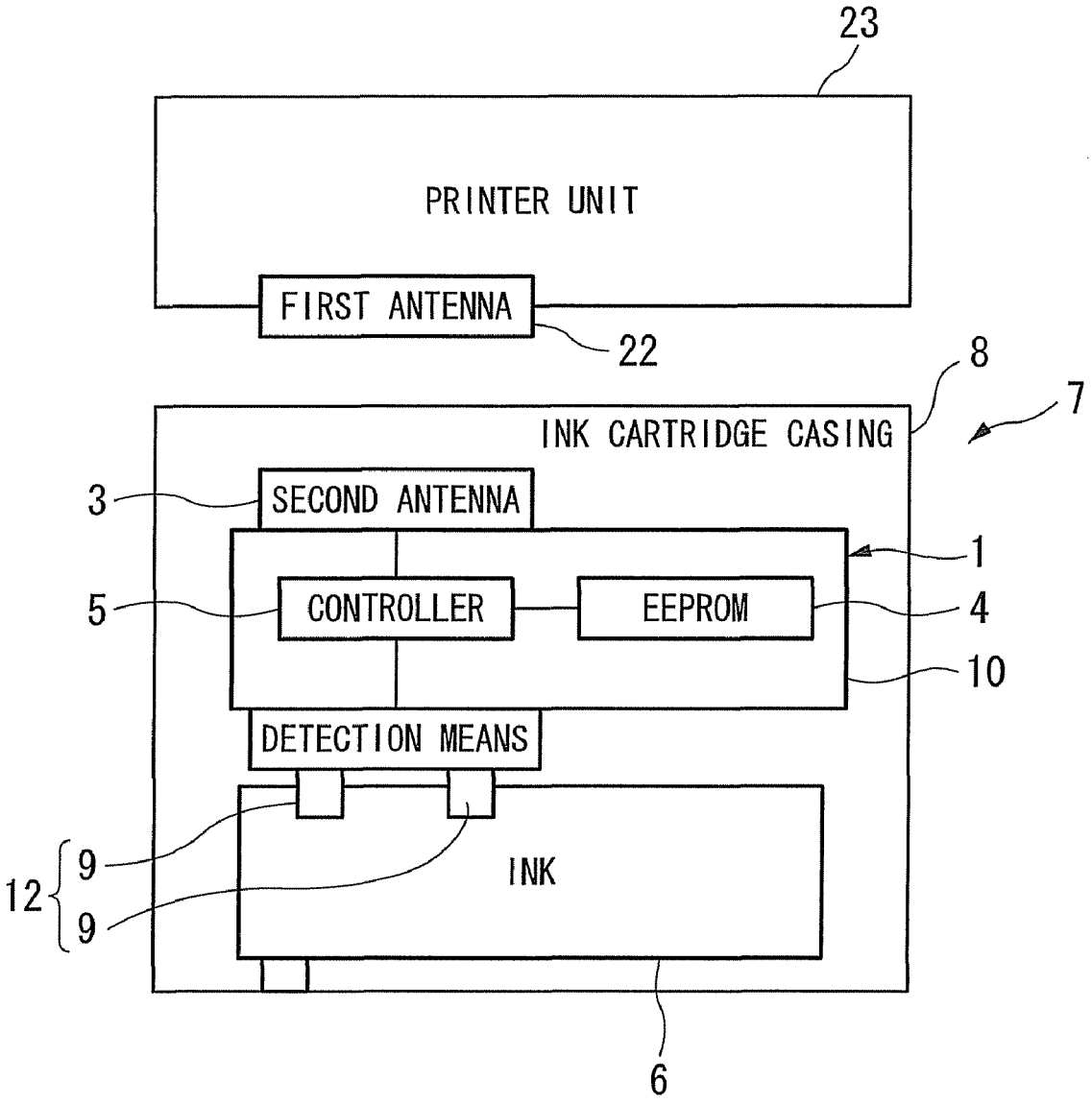
FIG. 1 is a schematic block diagram of an ink jet printer according to an example of the invention.

FIG. 1 is a schematic block diagram of an electronic device of the invention.

Figure 2:
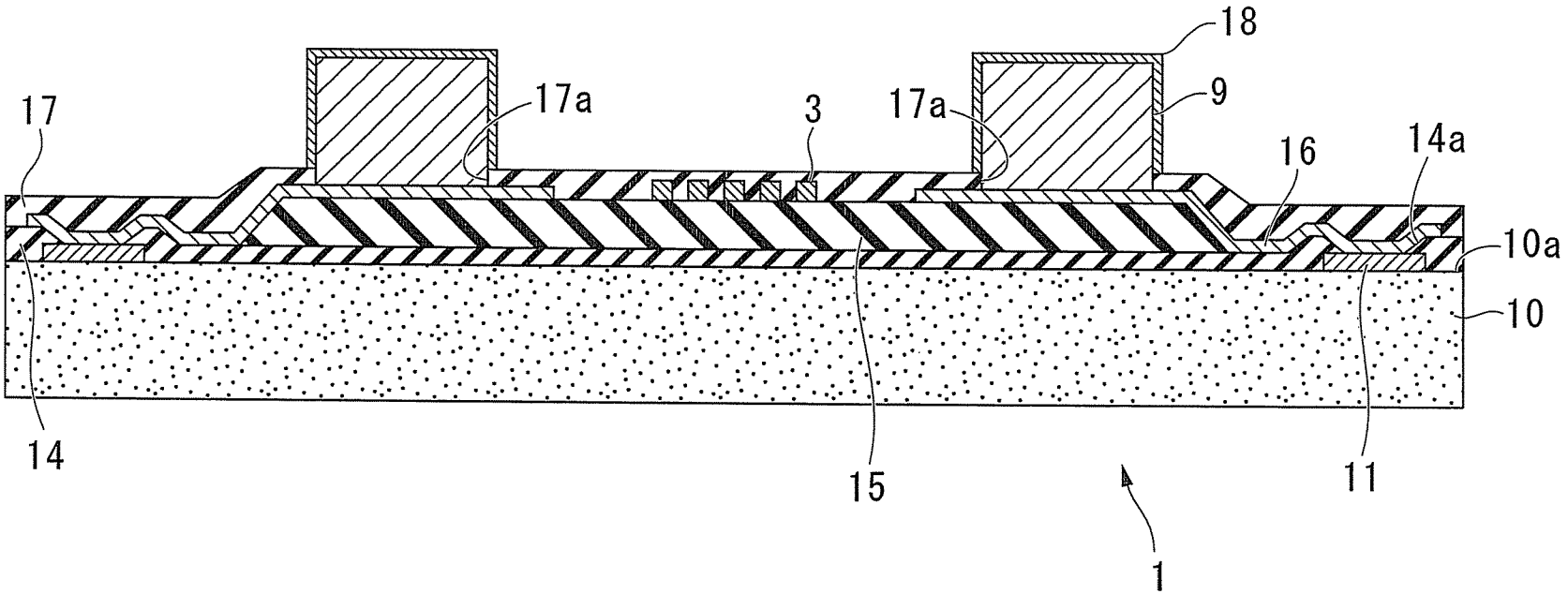
FIG. 2 is a cross-sectional view of a schematic diagram of a semiconductor device according to a first embodiment of the invention.

FIG. 2 is a cross-sectional view of a first embodiment of a semiconductor device of the invention.

Figure 3:
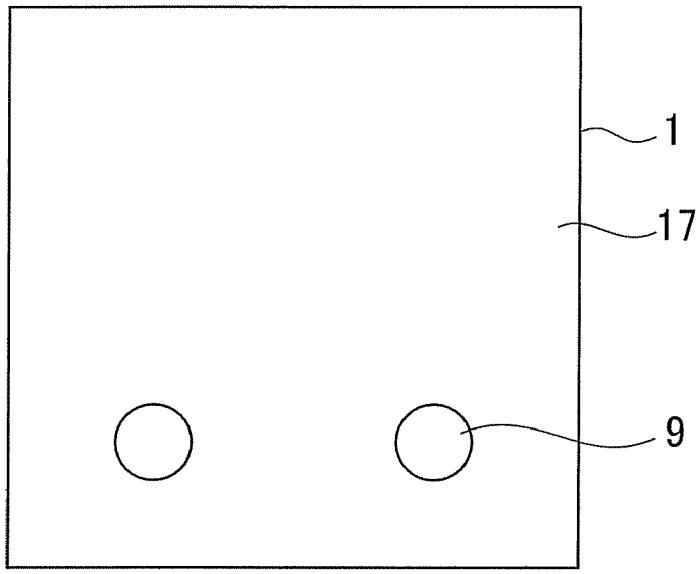
FIG. 3 is a plan view of the exterior of a semiconductor device according to a first embodiment of the invention.

FIG. 3 is an exterior view of a first embodiment of a semiconductor device of the invention.

In these diagrams, reference numeral 1 represents a semiconductor device having a wafer level chip scale package (W-CSP) structure.

The semiconductor device 1 includes liquid contact electrodes 9 (detection electrodes), a second antenna 3, an EEPROM 4 (storage circuit), and a controller 5 (control circuit), which are provided on a rectangular semiconductor substrate 10.

The liquid contact electrodes 9 detect a remaining amount of ink.

The second antenna 3 transmits and receives information to/from a first antenna 22 of the printer unit 23. The EEPROM 4 stores ink information.

The controller 5 controls the liquid contact electrodes 9, the second antenna 3, and the EEPROM 4.

The semiconductor substrate 10 is made from silicon.

An integrated circuit (not shown) includes the controller 5 and the EEPROM 4 constituted by active elements such as transistors, and is formed on an active element formation face 10*a* of the semiconductor substrate 10.

The integrated circuit includes at least an interconnection pattern, the EEPROM 4, the controller 5, and other active components being mutually connected by interconnections or the like.

In this embodiment, the EEPROM (nonvolatile memory) 4, which is a readable/writable recording medium, is used as the storage circuit.

The controller 5 performs updates or the like of ink information stored in the EEPROM 4 based on ink information remaining in the ink cartridge 7.

Instead of silicon, another material such as glass, quartz, and liquid crystal can be used in forming the semiconductor substrate 10.

A pair of element electrodes 11 for making the integrated circuit conductive is provided in a peripheral portion of the active element formation face 10*a* of the semiconductor substrate 10.

Since the element electrodes 11 are formed so as to conduct directly with the integrated circuit of the semiconductor substrate 10, they are arranged in a peripheral portion of the rectangular semiconductor substrate 10.

Titanium (Ti), titanium nitride (Tin), aluminum (Al), copper (Cu), an alloy of these, or such like, can be used as material for the element electrodes 11.

In this embodiment, aluminum (Al) is used as the material for the element electrodes 11.

The integrated circuit and the element electrodes 11 are protected by covering them with a passivation film 14 formed on the active element formation face 10*a*.

The material used for the passivation film 14 is an electrical insulating material such as, for example, polyimide resin, silicone-modified polyimide resin, epoxy resin, silicone-modified epoxy resin, acrylic resin, phenol resin, benzocyclobutene (BCB), and polybenzoxazole (PBO).

Also, an inorganic material such as silicon oxide ($SiO_2$) and silicon nitride ($Si_3N_4$) can be used.

In this embodiment, polyimide resin is used as the material for the passivation film 14.

Openings 14*a* are formed in the passivation film 14 above the element electrodes 11.

With this configuration, the element electrodes 11 are exposed to the outside via the openings 14*a*.

In the passivation film 14 of this embodiment, a dielectric layer 15 is formed in a center portion of the semiconductor substrate 10 at a position avoiding the element electrodes 11.

The dielectric layer 15 is constituted from photosensitive polyimide resin, silicone-modified polyimide resin, epoxy resin, silicone-modified epoxy resin, etc.

A relocation interconnection 16 (conductive layer) is electrically connected to the element electrodes 11 in the openings 14*a* of the passivation film 14.

The relocation interconnection 16 is for relocating the element electrodes 11 of the integrated circuit, and is therefore formed extending from the element electrodes 11 arranged in a peripheral part of the semiconductor substrate 10 to the center sides of the semiconductor substrate 10 and also rising onto the dielectric layer 15.

The relocation interconnection 16 is generally so called since it connects the element electrodes 11 of the semiconductor substrate 10 with the liquid contact electrodes 9 explained later.

The relocation interconnection is an important means of deviating the positions of the element electrodes 11 of the semiconductor substrate 10 that is often designed in minute detail and the physical positions of the rough-pitch liquid contact electrodes 9.

Figure 5:
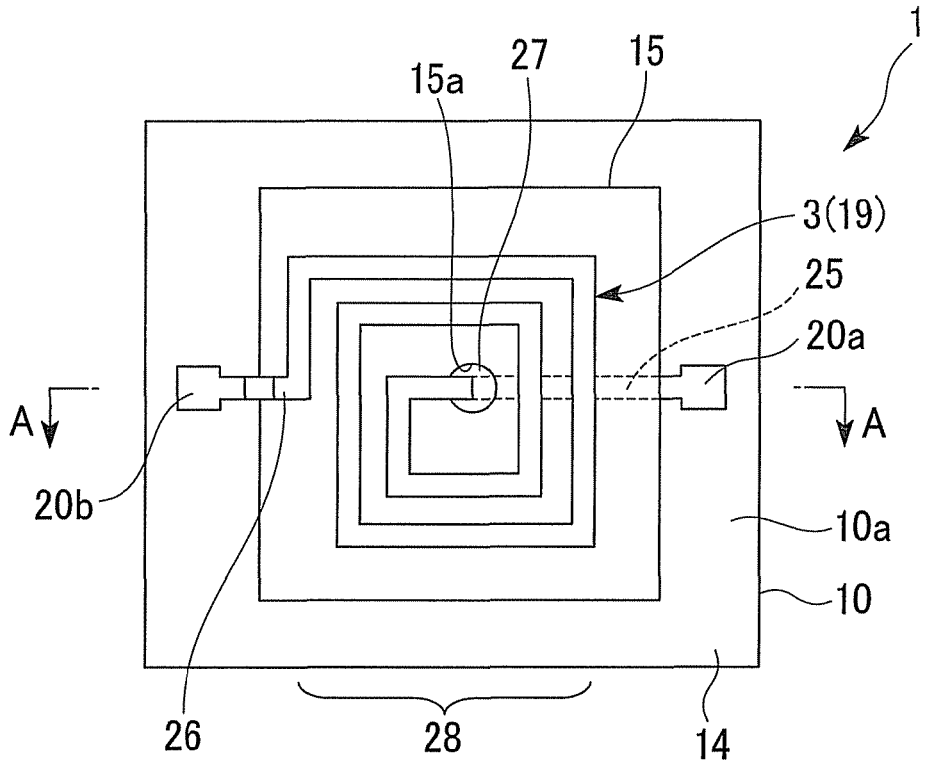
FIG. 5 is plan view of a schematic diagram of a second antenna.

As shown in FIG. 5, in addition to the element electrodes 11, electrodes 20*a* and 20*b* are formed in the integrated circuit on the semiconductor substrate 10 using a material similar to that of the element electrodes 11.

A relocation interconnection 19 is connected to the electrodes 20*a* and 20*b* in the same manner as the element electrodes 11.

The relocation interconnection 19 extends from the electrodes 20*a* and 20*b* to the center portion and rises onto the dielectric layer 15.

The relocation interconnection 19 that rises onto the dielectric layer 15 is arranged so as not to interfere with the relocation interconnection 16 (see FIG. 2), and becomes the second antenna 3 that communicates with the first antenna 22 of the printer unit 23.

It is possible to detect whether ink is present by measuring the resistance and current between the liquid contact electrodes 9.

For example, if one liquid contact electrode 9 is connected to a transistor gate of a controller circuit and the other liquid contact electrode 9 is connected to the power source, a transistor that is ON when there is ink will switch OFF when there is no ink.

By detecting this switch, it is possible to determine whether ink is present.

In order to prevent deterioration in the ink composition due to electrolysis, the current flowing between the liquid contact electrodes 9 is made as small as possible, and is preferably pulsed.

As described above, the second antenna 3 is provided roughly in the center portion of the semiconductor substrate 10, and is constituted by a flat-type inductor element (spiral inductor element).

Figure 6:
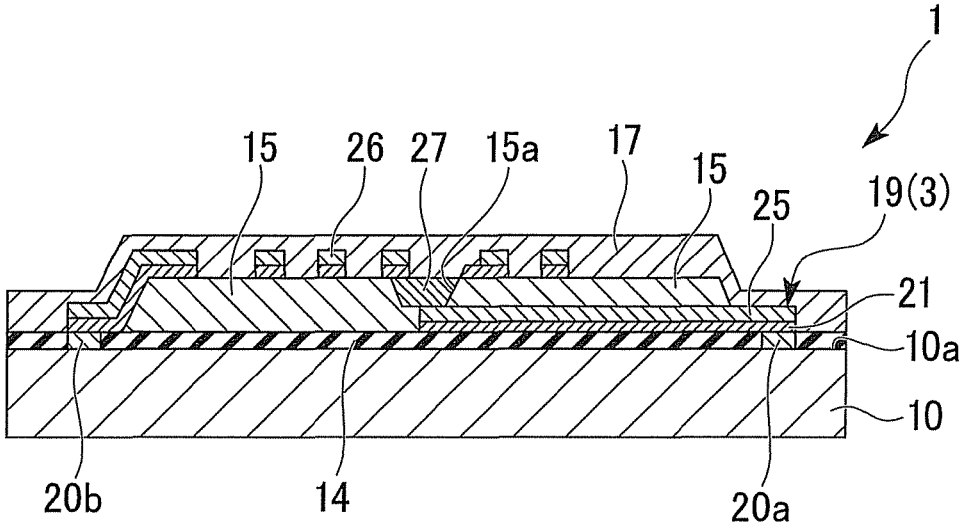
FIG. 6 is a cross-sectional view of a schematic diagram of a second antenna.

As shown in FIG. 6, the relocation interconnection 19 arranged on the surface of the dielectric layer 15 is formed on the same flat face in cross-sectional view, and has a spiral shape in the plan view shown in FIG. 5.

The second antenna 3 is formed by the relocation interconnection 19 arranged from the electrode 20*a* of the semiconductor substrate 10 across to the electrode 20*b*. Furthermore, as shown in FIG. 6, the second antenna 3 includes an bottom layer interconnection 25 provided at the bottom side of the dielectric layer 15, and a upper-layer interconnection 26 provided at the top side of the dielectric layer 15.

The bottom layer interconnection 25 and the upper-layer interconnection 26 are connected via a connector 27 that is formed by embedding Cu in a hole 15*a* provided in the dielectric layer 15.

Thus, the upper-layer interconnection 26 is arranged so as not to be short-circuiting with the bottom layer interconnection 25 on the passivation film 14.

Of the bottom layer interconnection 25 and the upper-layer interconnection 26, the upper-layer interconnection 26 is relatively separated from the semiconductor substrate 10 and forms a spiral section 28 such as that shown in FIG. 5.

Since the dielectric layer 15 is provided between the spiral section 28 and the semiconductor substrate 10, the spiral section 28 can be further separated from the semiconductor substrate 10.

Therefore, the characteristics of the second antenna 3 can be enhanced.

The inside ends of the second antenna 3 are joined to the electrode 20*a* via the bottom layer interconnection 25 of the relocation interconnection 19.

The outside ends are joined to the electrode 20*b* via the upper-layer interconnection 26.

As shown in FIG. 6, a sputtering layer 21 of Cu at the bottom side of the second antenna 3 is used in forming the second antenna 3.

Forming the second antenna 3 on the dielectric layer 15 in this manner achieves clearance with the semiconductor substrate 10, which is an electromagnetic wave absorber, thereby reducing current leakage from the second antenna 3 and increasing its transmission efficiency.

When the dielectric constant of the dielectric layer 15 is increased, a second antenna 3 of short length can be formed in a narrow area. It is possible to miniaturize the semiconductor device 1 and also helping to reduce the manufacturing cost.

Since the relocation interconnection 16 and the relocation interconnection 19 are formed in a single step (same step), they are made of the same material.

While single-layer film, multi-layered film, or alloy film of gold (Au), copper (Cu), silver (Ag), titanium (Ti), tungsten (W), titanium tungsten (TiW), titanium nitride (TiN), nickel (Ni), nickel vanadium (NiV), chrome (Cr), aluminum (Al), palladium (Pd), and so on, can be used as the material used for the relocation interconnections 16 and the 19, in this embodiment they are formed from Cu plated film.

By simultaneously forming the relocation interconnection 16 and the relocation interconnection 19 in this way, they form a single layer on the same face (the active element formation face 10*a*). It is possible to reduce the manufacturing steps and lowering the manufacturing cost.

A protective layer 17 (protective film) is then formed on or above the active element formation face 10*a* of the semiconductor substrate 10 so as to cover the relocation interconnection 16, the second antenna 3, the dielectric layer 15, and the passivation film 14.

The protective layer 17 is made from a heat-resistant material of solder resist.

For example, an alkali-resistant resin such as polyimide resin, PPS, and PE is used for forming the protective layer 17.

Alternatively, SiN, $SiO_2$, SiON, or the like, can be used to form an inorganic film.

It is preferable that a material having a liquid repellency to the ink be used for the protective layer 17 in order to prevent a decrease in the resistance between the liquid contact electrodes 9 caused by ink remaining on the surface of the protective layer 17 (in order to enhance the S/N ratio of the wetted sensor) when the ink in the ink tank decreases to a small amount. In this embodiment, polyimide resin is used.

Openings 17*a* are provided in the protective layer 17 over each of the relocation interconnections 16 of the dielectric layer 15.

With this configuration, the relocation interconnections 16 are partially exposed to the outside via the openings 17*a*.

The surface of the protective layer 17 can be treated with a process such as fluorination treatment and silicone treatment. This broadens the range of resin materials that can be selected, even if the entire protective layer 17 does not have a liquid repellency to the ink.

The protective layer 17 can also cover the side faces and bottom face of the semiconductor device 1.

This ensures that the semiconductor device 1 is not damaged by the ink.

As shown in FIG. 2, a bump is provided above the relocation interconnections 16 exposed through each opening 17*a*.

This bump is formed by growing an Au-plated film 18 (plated layer) on the surface of a core of Cu that can be plated at high-speed.

This bump functions as the liquid contact electrodes 9 for detecting ink information when the bump is wetted with ink.

By forming the Au plated film 18 on the Cu core surface, infiltration of ink to the semiconductor substrate 10 can be reliably prevented.

It is preferable that a metal which has excellent chemical resistance and is not affected by a strong alkaline ink component be used as the plated film.

Instead of this Au-plated film, Pt-plated film, Ni-p plated film, Ni-p+Au plated film, and such like, can also be used.

Since the dielectric layer 15 is already provided below the liquid contact electrodes 9, the distance from them to the active element formation face 10*a* can be increased, further preventing the ink from affecting the active elements.

In the semiconductor device 1 having this configuration, the EEPROM 4 collectively monitors a wide range of information relating to the ink using ink information obtained via the first antenna 22 from the printer unit 23 described below and ink information detected by the liquid contact electrodes 9.

Ink information from the printer unit 23 includes, for example, a ejected droplet count number, information indicating whether the ink cartridge 7 can be used, and so on, while ink information from the liquid contact electrodes 9 includes the remaining amount of ink (whether ink is present) and so on.

It is preferable that ink information including the ink type (color), the usable period of the ink, the ink filling date, the number of ink fillings (history information), or the like, be written to the EEPROM 4 before being shipped from the factory.

While this embodiment depicts an example using a storage circuit as the EEPROM 4, another storage element such as a Flush MEMORY can be used instead.

By configuring the semiconductor device 1 as a single unit combining the liquid contact electrodes 9, the second antenna 3, the controller 5, and the EEPROM 4 in this manner, it is easily inserted to the ink cartridge 7, easily manufactured, and the manufacturing cost can be reduced.

Since the liquid contact electrodes 9 can detect the remaining amount of ink in the ink tank 6 (container) or the like, it is possible to reliably determine whether there is ink in the ink cartridge 7.

As a result, it is possible to substitute the ink cartridge 7 without leaving any ink in the ink tank 6, and thereby reduces the cost of ink for the user.

In this invention, if the second antenna 3 is arranged so that it does not interfere with the positions of the liquid contact electrodes 9 and consequently without loss of design freedom, the second antenna 3 can be extended to a desired position from the electrodes 20*a* and 20*b* by relocation interconnections.

The second antenna 3 can be formed by a pad or the like separate from the relocation interconnection 19 and the electrodes 20*a* and 20*b*.

Instead of using the relocation interconnection 19 to form the second antenna 3, the second antenna 3 can be formed from an interconnection (Al, Cu) that is used when forming the integrated circuit.

The same goes for the relocation interconnection 16.

FIG. 3 is an example of the exterior of the semiconductor device 1 of the invention shown in cross-sectional view in FIG. 2.

In this example, detection electrodes include a pair of liquid contact electrodes 9, it being possible to detect whether ink is present by measuring the resistance and current between them.

Figure 4:
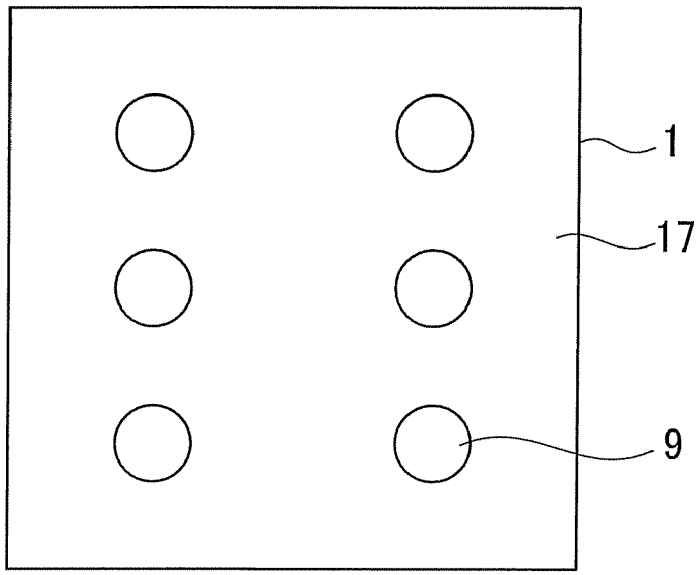
FIG. 4 is a plan view of the exterior of another embodiment of a semiconductor device.

FIG. 4 is another example of the exterior of the semiconductor device 1 of the invention shown in cross-sectional view in FIG. 2.

In this example there are six liquid contact electrodes 9.

With this arrangement, even if the detection precision of one pair of liquid contact electrodes 9 decreases due to air bubbles or dirt between them, the detection precision can be supplemented between the other pairs of liquid contact electrodes 9. It is possible to obtain accurate information relating to whether ink is present.

In this case, reduction in precision can be prevented by using more than one pair of liquid contact electrodes 9, and the detection precision increases as the number of liquid contact electrodes 9 increases.

Figure 7:
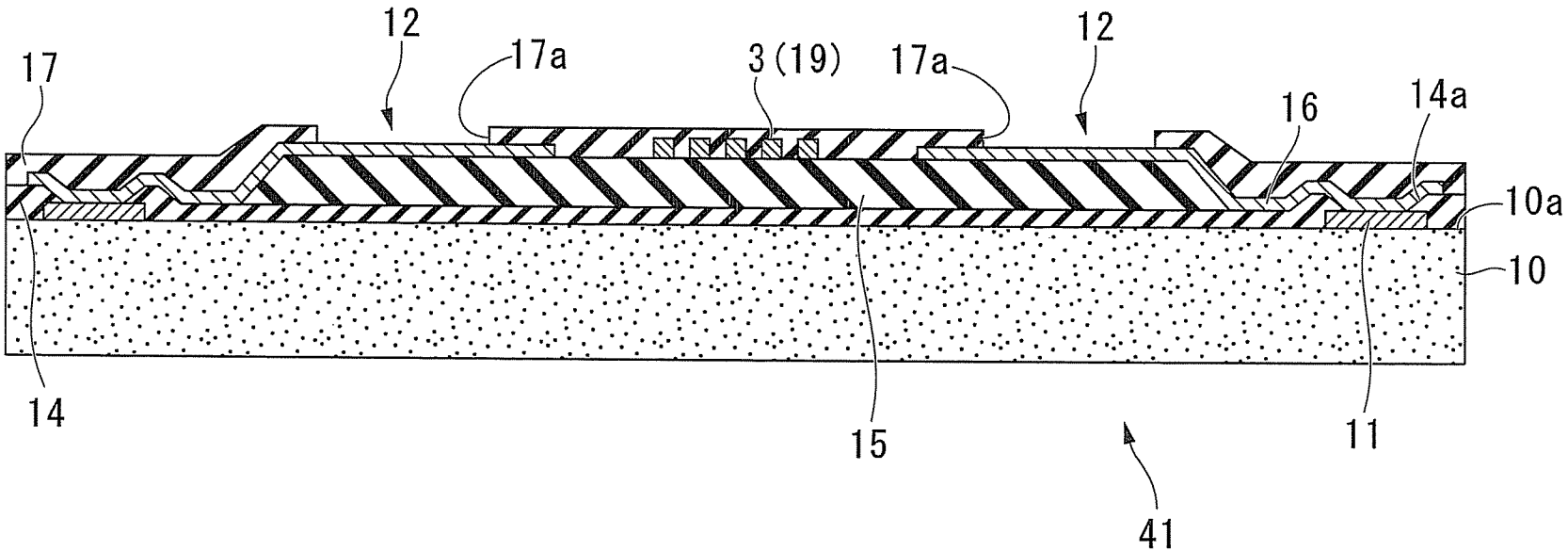
FIG. 7 is a cross-sectional view of a schematic diagram of a semiconductor device according to a second embodiment of the invention.

A second embodiment will be described with reference to FIG. 7.

Reference numeral 41 represents a semiconductor device of the invention.

This embodiment differs from the first embodiment in that parts of the relocation interconnections 16 exposed through the openings 17*a* in the protective layer 17 are used as liquid contact electrodes 12 (detection electrodes).

This embodiment detects ink information when the relocation interconnections 16 are wetted by ink infiltrating into the openings 17*a*.

To achieve this, an Au-plated film (not shown) having excellent chemical resistance is provided above the relocation interconnections 16 exposed through the openings 17*a* in the same manner as described above.

This Au-plated film prevents ink from infiltrating the semiconductor device 41 from the openings 17*a*.

As a result, it is possible to prevent the ink from affecting the active elements (integrated circuit) on the active element formation face 10*a* of the semiconductor device 41.

By using parts of the relocation interconnections 16 as liquid contact electrodes 12 in this manner, similar effects to those of the first embodiment can be obtained with a simple configuration.

The above embodiments describe the semiconductor device 1 in which the second antenna 3 and the liquid contact electrodes 9 are provided on the semiconductor substrate 10. Alternatively, for example, when desiring to enhance the performance of the second antenna unit, the semiconductor device 1 can be configured as an all-in-one module structure packaged on a separate high-performance antenna. A semiconductor device having an all-in-one module structure can also be arranged in a single piece with a relay antenna.

Ink Cartridge

Figure 8:
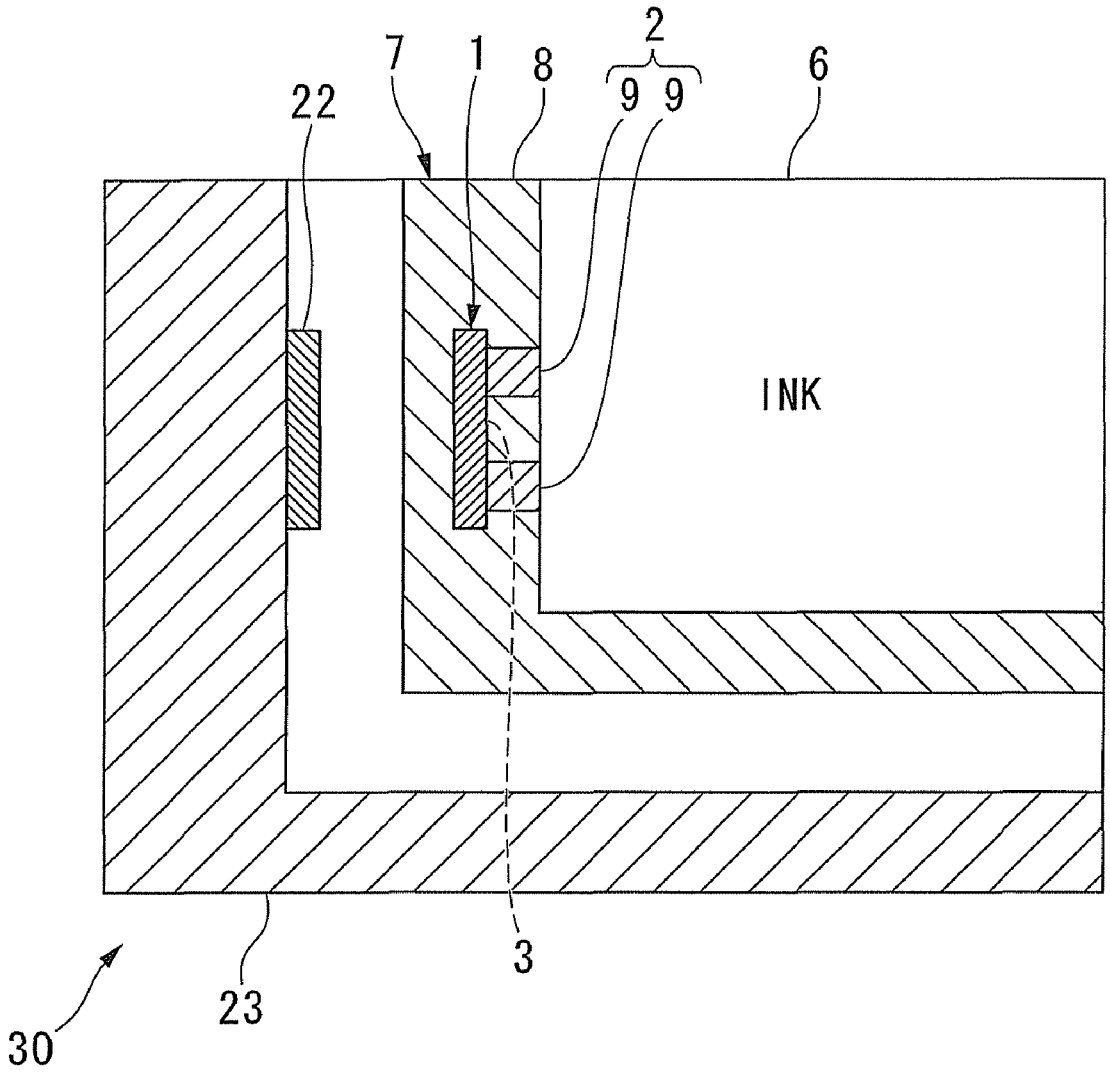
FIG. 8 is a cross-sectional view for explanation of an ink cartridge of the invention.

Reference numeral 7 in FIGS. 1 and 8 represents an ink cartridge attached to a printer unit 23 (electronic device unit) that includes a first antenna 22 described below.

This semiconductor device 1 includes a function of a liquid sensor that manages and detects ink information in the ink cartridge 7.

As shown in FIG. 8, the ink cartridge 7 is formed in a single piece by, for example, resin injection molding, such that the semiconductor device 1 is accommodated in an ink cartridge casing 8 that includes an ink tank 6 for containing ink.

A pair of liquid contact electrodes 9 of the semiconductor device 1 is exposed in the ink tank 6 containing the ink.

Parts of the semiconductor device 1 other than the liquid contact electrodes 9 are embedded in the ink cartridge casing 8.

The semiconductor device 1 is arranged below a wall section of the ink cartridge casing 8 such that the pair of liquid contact electrodes 9 dispose along the bottom face of the ink tank 6.

Predetermined types of ink are contained in the ink tank 6 of each ink cartridge 7, the ink being fed out from a predetermined location in each ink cartridge 7.

Since the liquid contact electrodes 9 are exposed in the ink tank 6 in this manner, ink information (remaining amount, etc.) in the ink tank 6 can be reliably detected by wetting the liquid contact electrodes 9 with the ink.

Since parts of the semiconductor device 1 other than the liquid contact electrodes 9 embedded in the ink cartridge 7, it is possible to prevent the controller 5 and the EEPROM 4 formed in these other parts from being damaged by the ink, thereby increasing the reliability of the controller 5 and the EEPROM 4.

Moreover, if the semiconductor device 1 is incorporated with the ink cartridge 7 by, for example, injection molding, the ink in the ink tank 6 can be reliably made airtight with the outside of the ink cartridge 7.

Therefore, ink does not leak from the part where the semiconductor device 1 is embedded, and ink leakage from the ink cartridge 7 is avoided.

Since the embedding process covers the liquid contact electrodes 9 with resin, incorrect determinations when the remaining amount of ink becomes small can be prevented.

The semiconductor device 1 can be attached in the ink cartridge 7 after formation of the ink cartridge 7.

The ink cartridge 7 can contain a plurality of semiconductor devices 1. In this case, for example, the liquid contact electrodes 9 are arranged at predetermined intervals along the depth direction of the ink tank 6 on a wall of the ink cartridge casing 8.

In this configuration, it is possible to detect the ink level, and to reliably ascertain the remaining amount of ink and the consumption course.

At this time, by arranging the liquid contact electrodes 9 of at least one semiconductor device 1 along the bottom face of the ink tank 6, it is possible to reliably detect whether ink is present.

While this embodiment describes a configuration where the second antenna 3 and the liquid contact electrodes 9 are arranged in a single structure on the semiconductor substrate 10, when further enhancing the performance of a second antenna unit, an additional relay antenna can be provided and the system can be configured as an all-in-one module structure.

Figure 10:
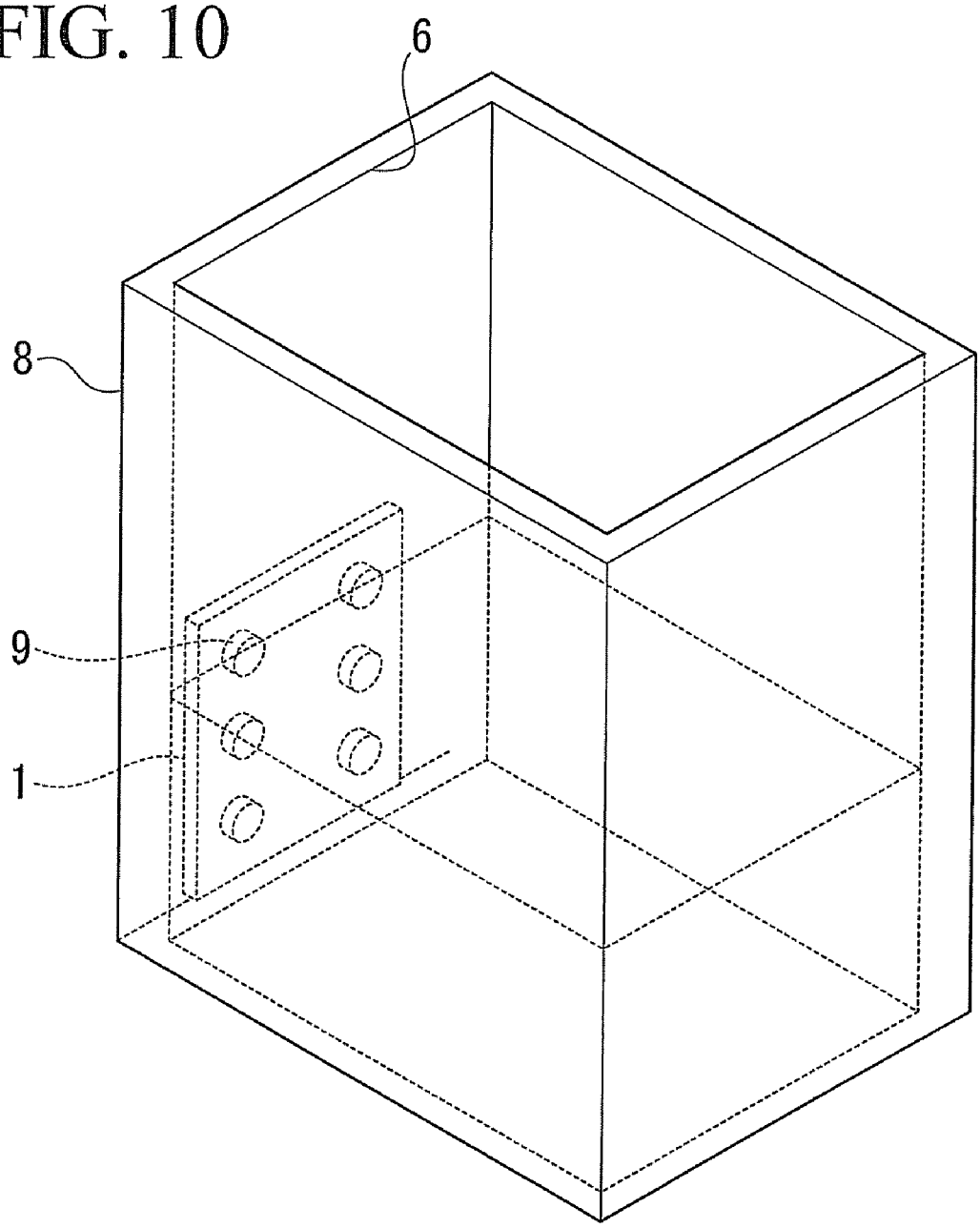
FIG. 10 is a plan view of a modification of an ink cartridge.

FIG. 10 is an embodiment of another ink cartridge 7 of the invention.

The semiconductor device 1 used here includes three pairs of liquid contact electrodes 9 as shown in FIG. 4.

The semiconductor device 1 is arranged along the depth direction of the ink tank 6 near the bottom of the inner wall of the ink cartridge casing 8.

Since there are three pairs of (i.e., six) liquid contact electrodes 9, the ink level can be detected by measuring which pair of liquid contact electrodes 9 the ink is contacting, and the remaining amount of ink and the consumption course can be reliably ascertained.

At this time, if at least one pair of liquid contact electrodes 9 is arranged along the bottom face of the ink tank 6, it is possible to reliably detect whether ink is present.

As a result, it is possible to detect the abovementioned information by the semiconductor device 1, and to achieve high-performance detection with a simple configuration.

More than three pairs of liquid contact electrodes 9 can be provided, whereby more detailed ink information can be obtained.

Subsequently, a printer unit will be explained with reference to FIGS. 1, 8, and 9.

Figure 9:
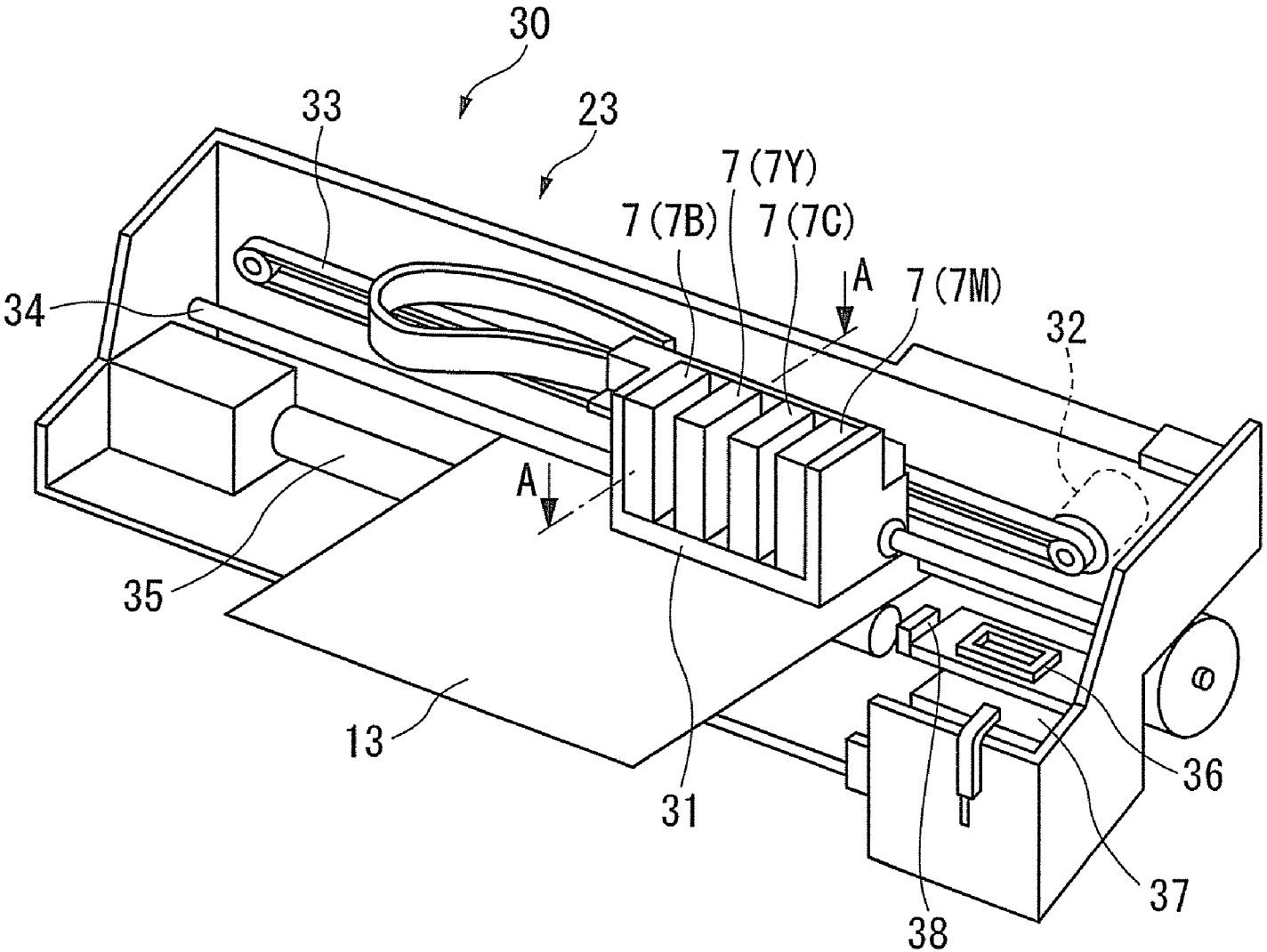
FIG. 9 is a perspective view of the main configuration of an ink jet printer wherein an ink cartridge containing a semiconductor device is attached to a printer unit.

FIG. 8 is a cross-sectional view taken along the line A-A of FIG. 9.

As shown in FIG. 9, a printer unit 23 includes a plurality of the abovementioned ink cartridges 7, which can be inserted and removed.

The printer unit 23 includes a recording head and a paper handling mechanism.

Ink is supplied from each ink cartridge to the recording head.

The paper handling mechanism delivers recording paper 13 relative to the recording head.

The printer unit 23 prints onto the recording paper 13 by ejecting ink onto it while moving the recording head in accordance with printing data.

As shown in FIG. 8, the printer unit 23 includes a first antenna 22.

The first antenna 22 communicates with second antenna 3 provided for each of the ink cartridges 7.

The printer unit 23 also includes a droplet ejection counter (not shown) that counts the number of ink droplets ejected from the ink cartridges 7, and calculates the remaining amount of ink in the ink tank 6.

As shown in FIG. 9, a plurality of ink cartridges 7 is inserted in the printer unit 23 of this configuration.

The ink cartridges 7 are attached in parallel and in an arrangement that is determined in advance according to the type of ink they contain.

Ink information is transmitted and received between the printer unit 23 and the ink cartridges 7 via wireless communication between the first antenna 22 and the second antenna 3.

The antennas 3 and 22 enable the information to be transmitted and received between the ink cartridges 7 and the printer unit 23 without contact between them.

This increases reliability, since there is no concern over electrical contact between the electronic device unit and the ink cartridges 7 as in the related art.

The information management cost can thereby be reduced.

When the ink cartridge 7 of this embodiment is attached in the printer unit 23, a required power can be extracted from electromagnetic waves that are used as carrier waves of the ink information output from the first antenna 22, and this power can be used to drive the semiconductor device 1.

With this arrangement, the second antenna 3 can jointly perform the functions of transmitting/receiving information and receiving power.

Furthermore, communication with the first antenna 22 and the second antenna 3 can be used in determining whether the ink cartridge 7 has been correctly attached in the printer unit 23.

For example, in the case in which the ink cartridge 7 is not correctly attached to the printer unit 23, content indicating this is displayed on a display unit or a computer screen.

Moreover, since the abovementioned semiconductor device 1 gives the ink cartridge 7 functions of management and detection, the number of interconnections in the printer unit 23 can be reduced and its structure can be simplified.

This can increase the freedom of the design layout of the printer unit 23.

According to the ink cartridge 7 having the configuration described above, even if the ink cartridge 7 is not attached in the printer unit 23, it is possible to refer to the content information of the EEPROM 4, write to the EEPROM 4, and so on. In addition, ink information from the liquid contact electrodes 9 can be stored in the EEPROM 4 without passing via the printer unit 23.

For example, at the time of manufacturing the ink cartridge 7, or for each packaging unit of the ink cartridge 7, ink manufacturing information or the like can be transmitted and received collectively.

Since the ink information stored in the EEPROM 4 of the ink cartridge 7 is preserved even when the power of the printer unit 23 is switched off and when the ink cartridge 7 is removed from the printer unit 23, it is possible to detect and manage the ink information in ink cartridge units, increasing the versatility of the ink cartridge 7.

The ink cartridge 7 can include a display unit for displaying the ink information stored in the EEPROM 4.

When using independent ink cartridges 7 for each color or the like, it is preferable that a semiconductor device 1 be incorporated in each independent ink cartridge 7 in order to handle information thereof.

A plurality of the first antennas 22 of the printer unit 23 can be provided for each ink cartridge 7.

To reduce the number of first antenna 22 of the printer unit 23, one or more antennas can be provided so as to transmit/receive information of each ink cartridge 7 every time a carriage 31 (described below) moves.

With this configuration, an analog wetted signal from the liquid contact electrodes can be output directly from the antenna as a digital signal via the controller.

Also, the number of mechanical connection points can be reduced, and the information can be output on a stable digital signal instead of an unstable analog signal that is vulnerable to noise.

Electronic Device

Subsequently, a primary configuration of an inkjet printer 30 (electronic device) according to the invention will be explained based on the embodiment shown in FIG. 9.

The inkjet printer 30 includes a plurality of ink cartridges 7 that can be attached and removed to/from the printer unit 23.

In FIG. 9, reference numeral 31 represents a carriage. This carriage is guided by a guide rod 34 while moving back and forth along the axial direction of a platen 35 by means of a timing belt 33 driven by a carriage motor 32.

The recording paper 13 is arranged in a scanning region scanned by the carriage 31, and is carried at a right angle to the scanning direction of the carriage 31.

A recording head is provided on a face of the carriage 31 that is opposite the recording paper 13.

Ink cartridges 7B, 7Y, 7C, and 7M that supply inks in colors of black, yellow, cyanogen, and magenta to the recording head are removably attached to its top.

A capping mechanism 36 is provided at a home position that is outside a non-printing region.

When the carriage 31 moves to the home position, in conjunction with the movement of the carriage 31, the capping mechanism 36 seals a nozzle formation face of the recording head that is mounted on the carriage 31.

The second antenna 3 of the ink cartridges 7 and the first antenna 22 (the first antenna 22 provided on the opposing section of the printer unit) face each other at the home position as shown in FIG. 8.

Consequently, each time one of the ink cartridge 7 returns to the home position, its ink information can be transmitted/received between its second antenna 3 and the first antenna 22.

Since this embodiment uses wireless communication, the configuration is not limited to that described above, it being possible to arrange the first antenna 22 at a position other than above each of the second antenna 3, thereby increasing the freedom of the unit design.

The capping mechanism 36 falls in conjunction with the movement of the carriage 31 toward the printing region, whereby the sealed state of the recording head can be cancelled.

A suction pump 37 is arranged below the capping mechanism 36, and applies negative pressure to an internal space of the capping mechanism 36.

The capping mechanism 36 functions as a lid for preventing drying of the nozzle opening of the recording head while the inkjet printer 30 is not in use.

The capping mechanism 36 also functions as an ink receiver when a flushing operation is performed in order to eject ink droplets by applying a drive signal unrelated to printing to the recording head.

Moreover, the capping mechanism 36 also functions as a cleaning mechanism that performs suction emission of ink from the recording head by applying the negative pressure from the suction pump 37 to the recording head.

A wiping member 38 made from an elastic plate of rubber or the like is arranged adjacent to a region of the capping mechanism 36 which is closer to the printing region.

When necessary, the wiping member 38 performs a cleaning operation by wiping the nozzle formation face of the recording head as the carriage 31 moves back and forth to the capping mechanism 36.

The inkjet printer 30 moves the recording paper 13 relative to the inkjet recording head which receives the supply of ink from the ink cartridges 7.

Recording is performed by ejecting ink droplets onto the recording paper 13 while moving the recording head in accordance with the printing data.

Figure 11:
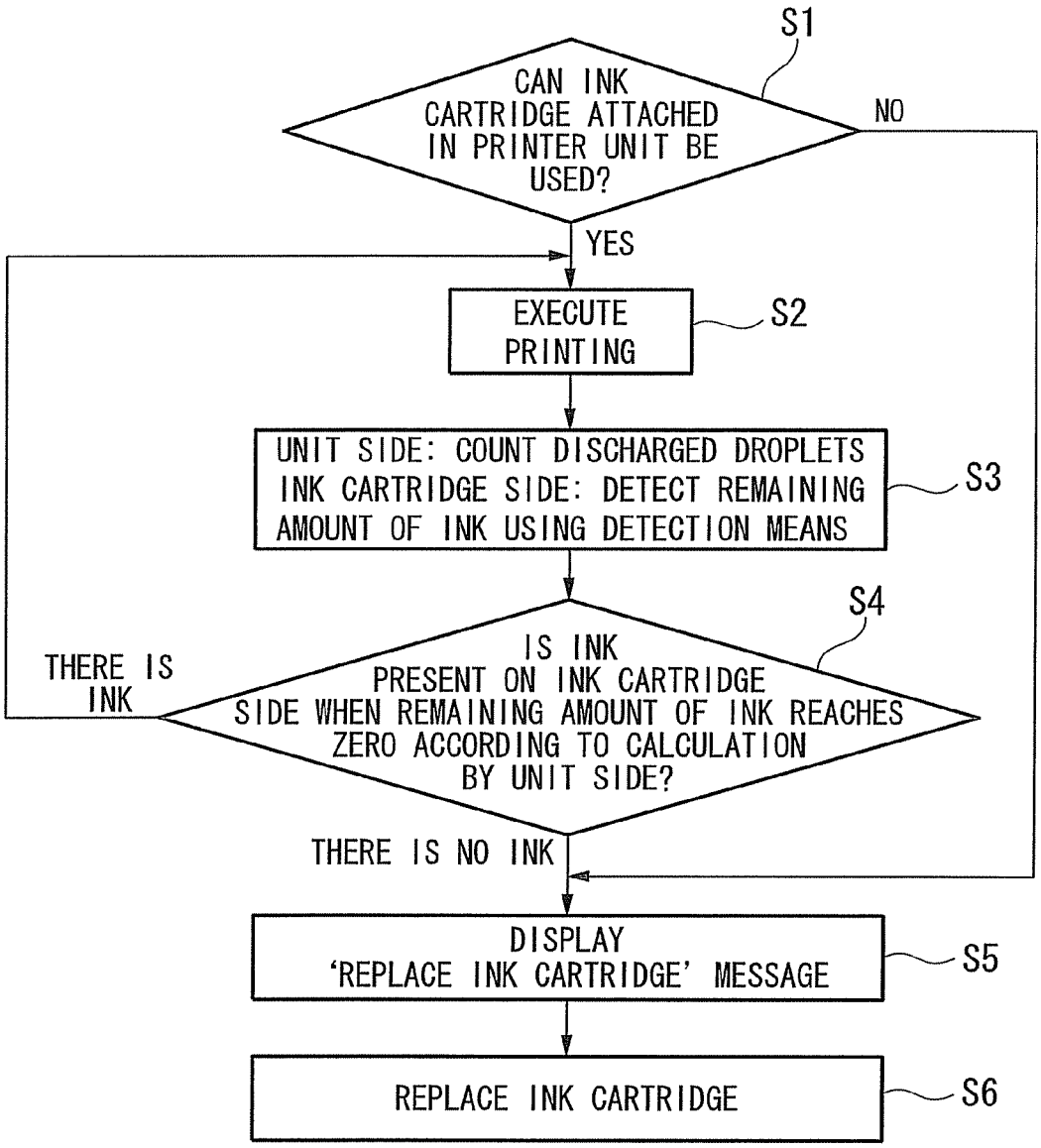
FIG. 11 is a flowchart of an ink jet printer system.

Subsequently, a system of the inkjet printer 30 will be explained with reference to FIG. 11.

Firstly, the ink cartridge 7 is attached to the printer unit 23.

In step S1, whether the ink cartridge 7 attached to the printer unit 23 can be used is detected. At this time, signals are transmitted and received between the first antenna 22 and the second antenna 3.

Power is then supplied to the second antenna 3 from the printer unit 23 by transmitting a signal from the first antenna 22, activating the IC of the semiconductor device 1 and applying a predetermined voltage to the liquid contact electrodes 9.

When the ink tank 6 contains ink, current flows between the liquid contact electrodes 9 while passing through the ink touching them.

Signals (current values) detected by the liquid contact electrodes 9 are output to the controller 5.

When the detected signal indicates conductivity between the liquid contact electrodes 9, the controller 5 determines that there is ink and supplies ink information (indicating whether ink is present) based on this determination to the EEPROM 4.

When that the ink cartridge 7 can be used is determined, this information is sent to the printer unit 23. The printer unit 23 enters a print standby state, and, when the printer unit 23 receives a print signal, recording of the printing data is executed as shown in step S2.

On the other hand, when the detected signal indicates no conductivity between the liquid contact electrodes 9, the controller 5 determines that there is no ink ('ink depleted' state).

Ink information (indicating whether ink is present) based on that determination is stored in the EEPROM 4, and the procedure shifts to step S5, in which a signal requesting replacement of the ink cartridge 7 is output to the printer unit 23.

By detecting the conductive state between the liquid contact electrodes 9 in this way, whether ink is present in the ink tank 6 is confirmed, and the usability of the ink cartridge 7 can be determined.

As shown in step S2, when the printer unit 23 is being driven so as to execute printing, as shown in step S3, the ink cartridge 7 detects the conductive state between the liquid contact electrodes 9 at predetermined times.

The detection signal (current value) detected by the liquid contact electrodes 9 is output to the controller 5.

The detection cycle of the ink information is adjusted as appropriate.

The controller 5 constantly updates the ink information of the EEPROM 4 based on the determination result.

In this manner, the remaining amount of ink (presence of ink) is monitored.

The controller 5 outputs the ink information stored in the EEPROM 4 via the second antenna 3 to the printer unit 23, where the ink information is supplied to the user from a display unit or from a computer screen.

As shown in step S3, software on the printer unit 23 calculates the amount of remaining ink from the sum of a count number of ejected ink droplets and the amount of ink used in maintenance.

The result is sent to the EEPROM 4 of the ink cartridge 7 via the first antenna 22 at each predetermined time, and the EEPROM 4 manages the remaining mount of ink (consumption amount).

In this way, ink-related information of the insulating layer 44 is constantly updated based on a signal output from the first antenna 22 of the printer unit 23.

Information stored in the EEPROM 4 is then supplied from the EEPROM 4 via the second antenna 3 to the user by being displayed a computer screen or a display unit on the printer unit 23.

In this manner, the user can monitor the progress of ink consumption, confirm the remaining amount of ink, etc.

Shortly after printing starts, for example, a calculation result indicating that the remaining amount of ink has reached zero is transmitted from the printer unit 23 to the controller 5.

However, as shown in step S4, when the detection signal between the liquid contact electrodes 9 indicates that ink is present (i.e., when the status between the liquid contact electrodes 9 is conductive), that ink remains in the ink tank 6 is clear, and therefore, that there is no ink in the ink tank 6 is not determined at this point; the procedure returns to step S2 and recording of the printing data is continued.

Thereafter as shown in step S4, when a signal indicating that the liquid contact electrodes 9 have ceased to be conductive is detected on the ink cartridge 7, the controller 5 determines, based on that signal, that a state of 'ink depleted' has been reached, and updates the ink information in the EEPROM 4.

Since the pair of liquid contact electrodes 9 are provided along the bottom face of the ink tank 6, the fact that they cease being conductive indicates that there is no ink in the ink tank 6.

Since this is more reliable than the calculation of remaining amount of ink made by the droplet ejection counter, the controller 5 always gives priority to the signal from the liquid contact electrodes 9 that actually contact the ink.

A discrepancy between the remaining amount of ink amount from the droplet ejection counter and the actual amount of ink remaining in the ink tank 6 often occurs due to variation in the weight of the ink droplets and variation in the amount of ink injected at the time of manufacture.

Priority is given to the signal from the liquid contact electrodes 9 in order to prevent a command being made to replace the ink cartridge 7 even when there is ink remaining in the ink tank 6 after the controller 5 determines that the ink cartridge 7 has reached a state of 'ink depleted' at the point where the remaining amount of ink according to the droplet ejection counter reaches zero.

After determining that the ink is depleted based on the signal from the liquid contact electrodes 9, in step S5, the controller 5 outputs a signal requesting replacement of the ink cartridge 7 to the printer unit 23, and a warning is issued to the user from a display unit (not shown) of the printer unit 23 or a computer screen.

In this manner, the user can know when to replace the ink cartridge 7.

As shown in step S6, an ink cartridge 7 that has reached the ink depleted state is removed from the printer unit 23 and replaced with a new ink cartridge 7.

For example, if the remaining amount of ink calculated by the droplet ejection counter on the printer unit 23 indicates that ink remains even though the liquid contact electrodes 9 of the ink cartridge 7 clearly indicate that the ink in the ink tank 6 has reached the ink depleted state, this is regarded as an error on the printer unit 23, and an error message is displayed on a display unit of the printer unit 23 or on a computer.

Furthermore, when the printer unit 23 calculates that the remaining amount of ink is zero, if the amount of ink remaining in the ink cartridge 7 at that point is determined to be much greater than the remaining amount of ink caused by variation in the weight of the ink droplets, that the ink droplets being ejected are of a smaller amount than usual is assumed.

In this case, a message suggesting that, for example, the ink ejection head should be cleaned, is displayed on a display unit or a computer screen.

Thus, the EEPROM 4 jointly manages ink information on the printer unit 23 and ink information that is detected using the liquid contact electrodes 9 of the ink cartridge 7, and detects errors in the printer unit 23 and the ink cartridge 7 by comparing the two types of information.

According to the inkjet printer 30 of this embodiment, since ink information can be reliably detected and managed with a simple configuration, it is possible to determine, for example, an appropriate replacement period of the ink cartridge 7.

As a result, since it is possible to replace the ink cartridge 7 without wasting ink, the replacement cycle of the ink cartridge 7 can be extended, reducing the cost for the user.

By managing the ink information in detail in this manner, the ink cartridge 7 can be recycled efficiently and without waste.

Furthermore for example, information such as the number of recycles of the ink cartridge 7 can be determined from information relating to the number of ink fillings, this information is useful not only to the user but also to the recycler (manufacturer).

It is therefore possible to provide a highly reliably, high-quality product that enables detection and management of information relating to ink in the ink cartridge 7 to be performed accurately and reliably with a simple configuration.

While preferred embodiments of the invention have been described and illustrated above, these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A semiconductor device comprising:

a semiconductor substrate including an active element formation face on which an active element and a first electrode electrically connected to the active element are formed;

a dielectric layer formed on the active element formation face;

detection electrodes detecting a remaining amount of ink by being wet in the ink, the detection electrodes being formed on the dielectric layer;

an antenna transmitting and receiving information, the antenna being formed on the dielectric layer;

a first interconnection connecting the first electrode and the detection electrodes, a part of the first interconnection being formed on the dielectric layer;

a storage circuit storing information relating to the ink; and a control circuit controlling the detection electrodes, the antenna, and the storage circuit.

2. The semiconductor device according to claim 1, further comprising:

a second electrode formed on the active element; and a second interconnection connected to the second electrode, a part of the second interconnection being formed on the dielectric layer;

wherein the antenna is a part of the second interconnection.

3. The semiconductor device according to claim 1, further comprising:

a protective film formed so as to cover the first interconnection; and an opening formed in the protective film, exposing at least a part of the first interconnection, wherein the detection electrodes are constituted by the part of the first interconnection exposed through the opening.

4. The semiconductor device according to claim 1, further comprising:

a protective film formed so as to cover the first interconnection;

an opening formed in the protective film, exposing at least a part of the first interconnection; and a bump formed on the first interconnection exposed through the opening, wherein the detection electrodes are constituted by the bump.

5. The semiconductor device according to claim 1, further comprising:

a plated layer formed on a surface of the detection electrodes.

6. The semiconductor device according to claim 1, further comprising:

three or more detection electrodes.

* * * * *